US005186557A

United States Patent [19]

Fushimi

[11] Patent Number: 5,186,557

[45] Date of Patent: Feb. 16, 1993

[54] PRINTER

[75] Inventor: Kazuhiro Fushimi, Mishima, Japan

[73] Assignee: Tokyo Electric Co., Ltd., Tokyo, Japan

[21] Appl. No.: 577,516

[22] Filed: Sep. 5, 1990

[30] Foreign Application Priority Data

Sep. 6, 1989 [JP] Japan ..... 1-231237

[51] Int. Cl.[5] ..... B41J 29/02

[52] U.S. Cl. ..... 400/691; 400/690.4; 400/693

[58] Field of Search ..... 400/595, 603, 682, 690.2, 400/691, 693, 680, 690.4, 692

[56] References Cited

U.S. PATENT DOCUMENTS

| | | | |
|---|---|---|---|
| 2,540,797 | 2/1951 | Freeman et al. | 400/680 |
| 2,776,738 | 1/1957 | Segui | 400/680 |
| 3,638,776 | 2/1972 | Ridge | 400/680 |
| 4,781,480 | 11/1988 | Kikuchi et al. | 400/691 |
| 4,830,525 | 5/1989 | Nagashima et al. | 400/682 |
| 4,851,812 | 7/1989 | Holmberg | 400/682 |
| 4,900,172 | 2/1990 | Suoboda | 400/690.1 |
| 4,976,559 | 12/1990 | Inagaki | 400/682 |
| 5,017,032 | 5/1991 | Hermann et al. | 400/691 |

FOREIGN PATENT DOCUMENTS

| | | | |
|---|---|---|---|
| 0008378 | 7/1979 | European Pat. Off. . | |
| 0113701 | 10/1984 | European Pat. Off. . | |
| 0143374 | 6/1985 | European Pat. Off. | 400/603 |
| 2716396 | 10/1988 | Fed. Rep. of Germany . | |
| 57-132550 | 2/1982 | Japan . | |
| 0066988 | 4/1982 | Japan | 400/691 |
| 0096881 | 6/1982 | Japan | 400/603 |
| 0019572 | 1/1985 | Japan | 400/603 |
| 0095975 | 4/1988 | Japan | 400/691 |

OTHER PUBLICATIONS

IBM Technical Disclosure Bulletin, vol. 23, No. 8, Document Insertion Device, Jan. 1981.

IBM Technical Disclosure Bulletin, vol. 28, No. 7 Electromagnetic Shield . . . , Dec. 1985.

*Primary Examiner*—Edgar S. Burr

*Assistant Examiner*—John S. Hilten

*Attorney, Agent, or Firm*—Oblon, Spivak, McClelland, Maier & Neustadt

[57] ABSTRACT

According to the present invention, a printer mechanism housing portion which houses a printer mechanism therein and has a paper insertion opening formed in the upper surface thereof is provided, and a flat terminal loading base is provided continuously to the lower side faces of the printer mechanism housing portion. The flat terminal loading base having a paper insertion passage in the interior thereof and also having a terminal loading surface as an upper surface. The paper insertion opening and the paper insertion passage being connected with each other in a curved form through a paper guide passage, whereby the space efficiency is enhanced to permit the reduction in size of the entire system.

7 Claims, 7 Drawing Sheets

PRINTER

FIELD OF THE INVENTION AND RELATED ART STATEMENT

The present invention relates to a printer for printing required matters on labels and the like used in the distribution industry, physical distribution industry, etc. Particularly, the present invention is concerned with a printer which employs a cut sheet as label paper.

There have been known printers using a cut sheet as label paper. Generally, in this type printer, label paper is set on a paper loading portion, then passed through a printing portion to the interior of the printer to be stored there, and at the time of discharge of the label paper, required matters are printed thereon in the printing portion. This conventional construction requires that a paper passage corresponding to the length of the paper should be formed within the printer. The paper passage is constituted of guide members arranged opposedly at predetermined intervals.

However, since such printers using a cut sheet are to be used on office desks, there has been a strong demand for the reduction of size. But the conventional printers of this type cannot fully satisfy such a demand for the reduction of size because it is necessary to form the paper passage corresponding to the paper length within the printers.

In the case where the paper passage extends between parts, it is formed using plural sets of guide members. Consequently, a paper jam sometimes occurs in the paper passage, and also there is a fear of collection of dust, etc. in the same passage. In the event of a paper jam in the paper passage, the only method for solution is to pull out the paper causative of the jam from an end of the paper passage. Further, for cleaning the paper passage to remove dust, etc., it is required to disassemble the paper passage.

OBJECT AND SUMMARY OF THE INVENTION

It is the first object of the present invention to provide a printer capable of reducing the size thereof.

It is the second object of the present invention to provide a printer which permits easy removal of paper even in the event of a paper jam in a paper passage and which also permits easy cleaning of the paper passage even when dust, etc. collect therein.

According to the present invention, in order to achieve the above-mentioned objects, there is provided a printer mechanism housing portion which houses a printer mechanism therein and has a paper insertion opening formed in the upper surface thereof; a flat terminal loading base is provided continuously to the lower side faces of the printer mechanism housing portion, the flat terminal loading base having a paper insertion passage in the interior thereof and also having a terminal loading surface as an upper surface; and there is formed a paper guide passage which connects the paper insertion opening and the paper insertion passage in a curved shape. Thus, since the interior of the terminal loading base serves as a paper insertion passage, the dead space is effectively utilized and a long paper passage can be formed within a narrow space occupied by the printer, whereby the reduction in size of the printer can be attained. Besides, when a terminal is put on the terminal loading base, the entire shape becomes generally rectangular and hence the entire system, including the terminal, is reduced in size.

In the case where the paper guide passage is formed by a pair of guide members vertically opposed to each other so that the lower guide member can be opened and closed together with the bottom plate of the printer body, the removal of paper causative of a jam in the paper guide passage can be done easily from the bottom side of the printer body in an opened state of the lower guide member. Also, it is easy to clean the paper guide passage for the removal of dust, etc.

DESCRIPTION OF THE PREFERRED EMBODIMENTS

Figure 1:
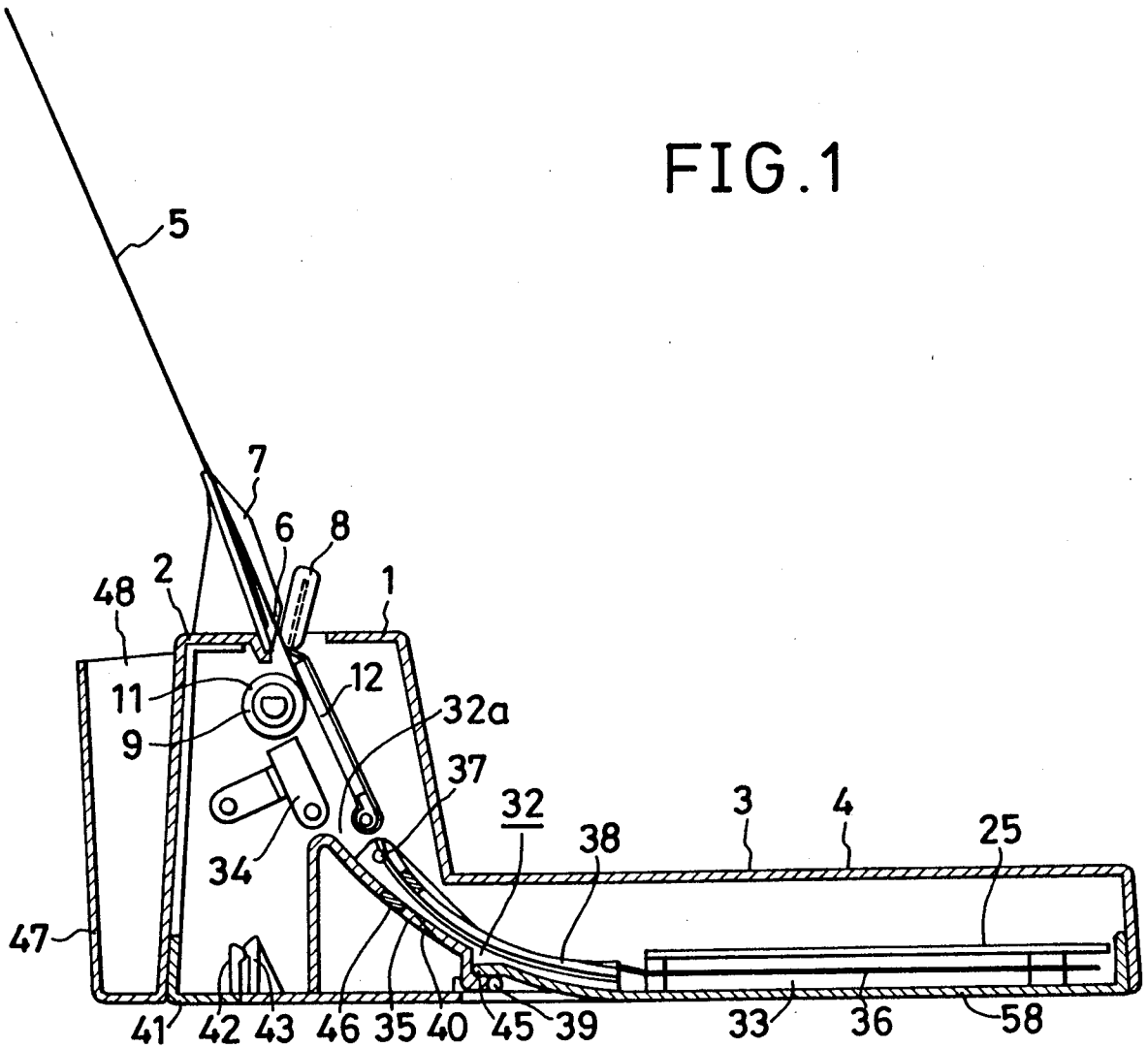
FIG. 1 is a side view in longitudinal section of a printer as a whole before the insertion of paper in an embodiment according to the present invention.
Figure 2:
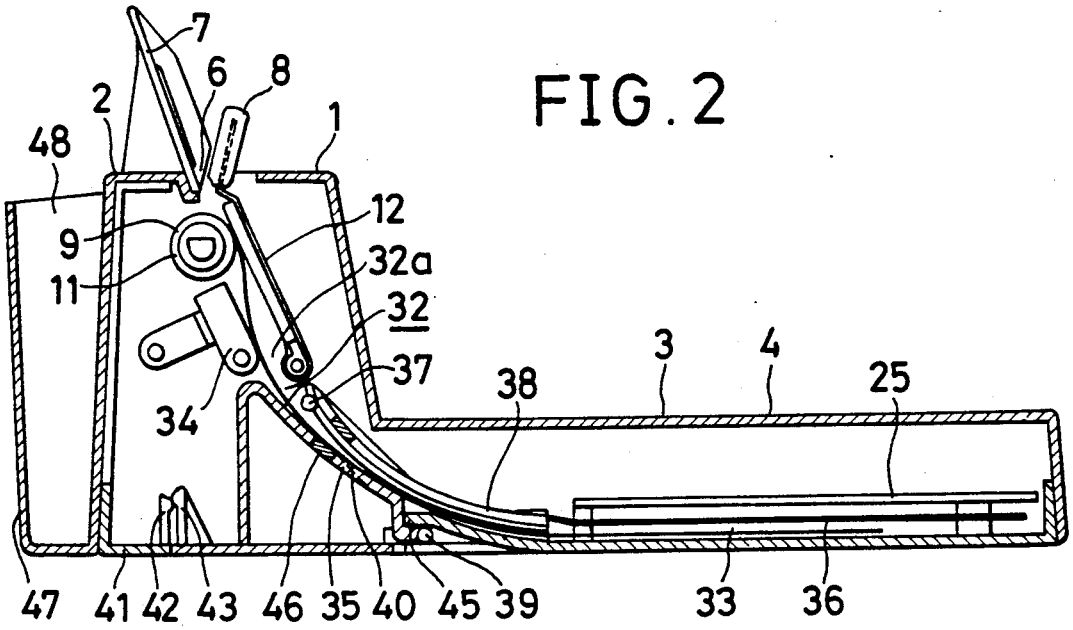
FIG. 2 is a side view in longitudinal section of a printer as a whole with paper inserted.
Figure 3:
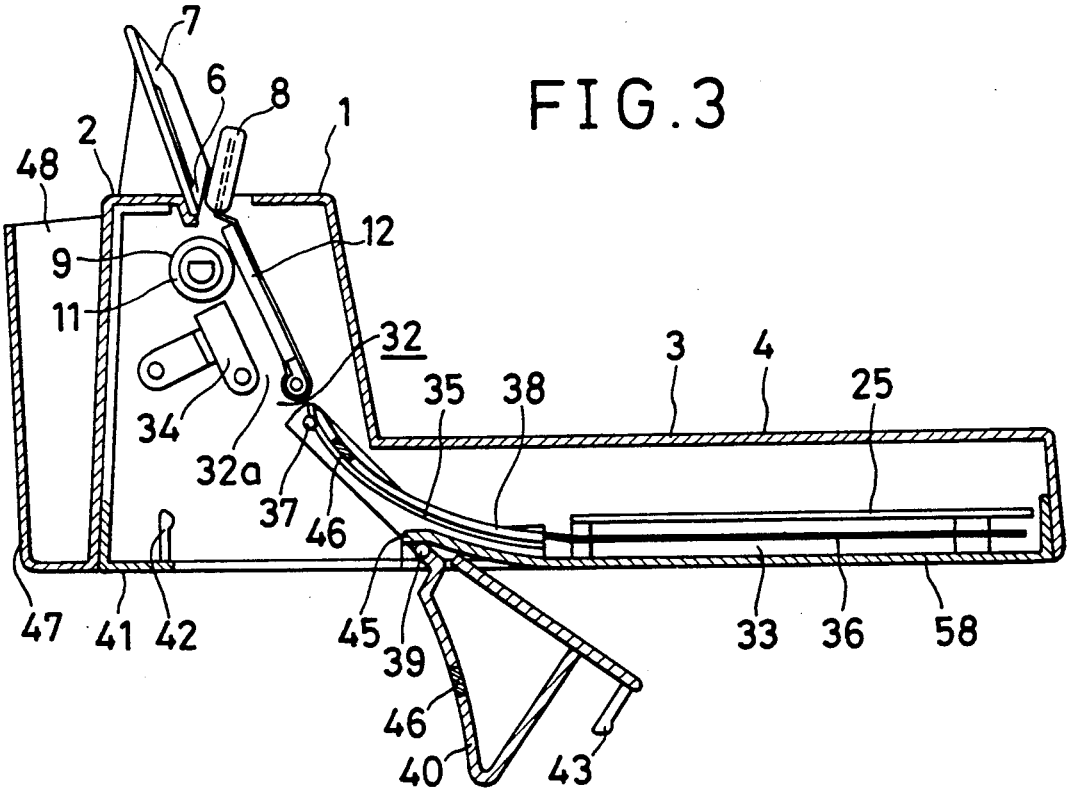
FIG. 3 is a side view in longitudinal section of a printer as a whole with a lower guide member opened.

An embodiment according to the present invention will now be described with reference to the drawings. FIGS. 1 to 4 illustrate an entire structure of a printer embodying the invention. A printer body 1, which is substantially L-shaped when viewed sideways, comprises an upwardly projecting printer mechanism housing portion 2 and a flat terminal loading base 4 of a small height contiguous to the printer mechanism housing portion 2 and having a terminal loading surface 3 as an upper surface.

A paper insertion opening 6 for paper 5 is formed in the upper surface of the printer mechanism housing portion 2 of the printer body 1. In the paper insertion opening 6, there is mounted a paper guide 7 projecting in a slightly upwards inclined state, while in opposed relation to the paper guide 7, there is disposed a head-up lever 8 which is inclined in the direction opposite to the inclined direction of the paper guide 7. The head-up lever 8 is contiguous to a later-described thermal head.

Figure 4:
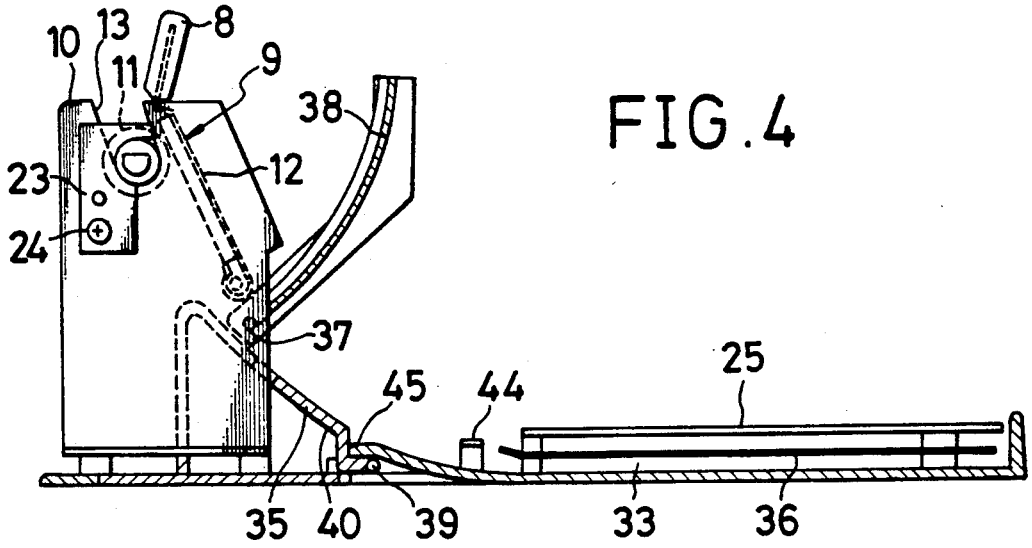
FIG. 4 is a side view in longitudinal section of a printer as a whole with an upper guide member opened.

The printer mechanism housing portion 2 houses a printer mechanism 9 therein, which is illustrated in detail in FIG. 4. The printer mechanism 9 is provided with a metallic chassis 10, and to the chassis 10 are mounted a cylindrical platen 11 and a thermal head 12 which is brought into pressure contact with the platen 11. The thermal head 12 is mounted pivotably while being urged toward the platen 11 with the lower end thereof as a fulcrum, and the head-up lever 8 is contiguous to the upper end of the thermal head 12 integrally. To the platen 11 is connected a driving mechanism (not shown) through a later-described driving gear.

Figure 5:
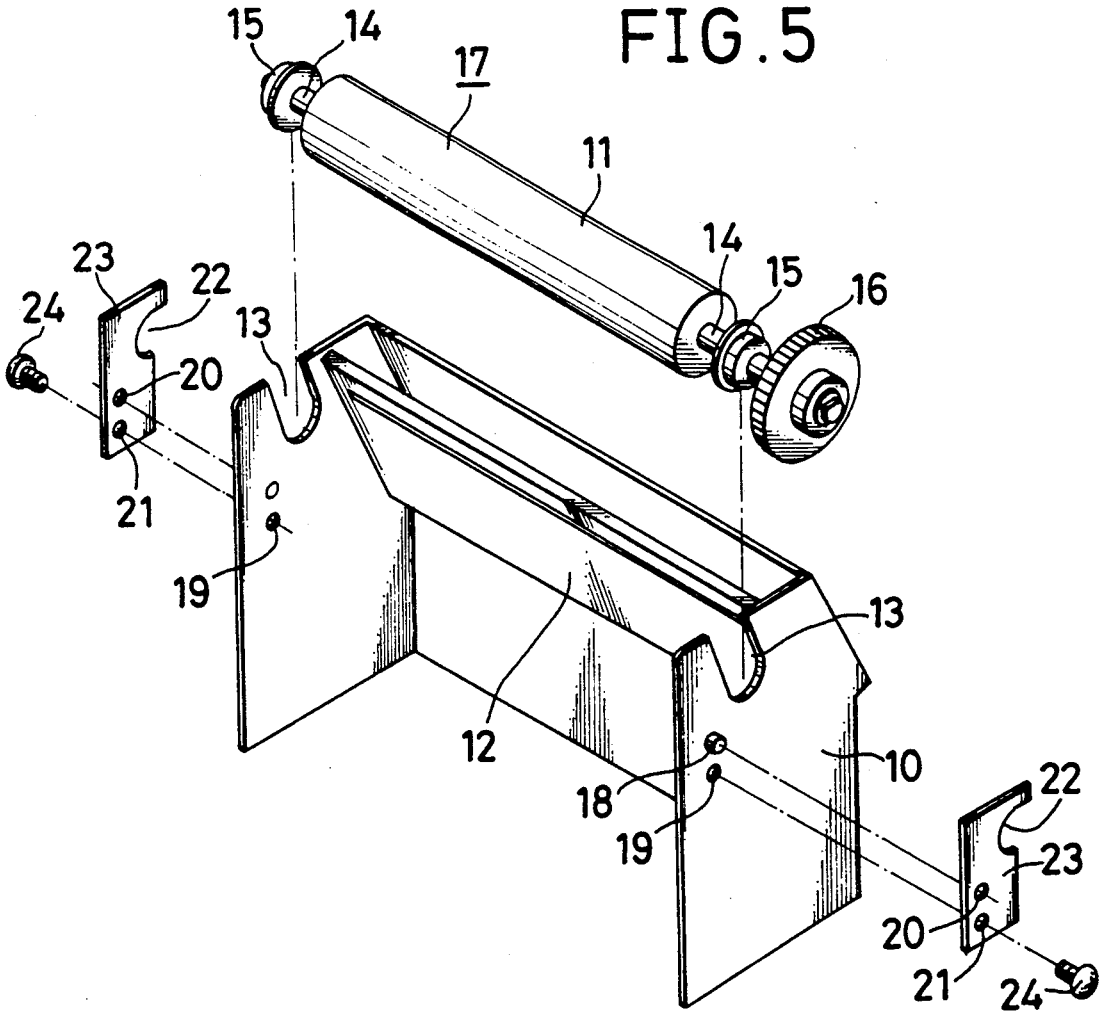
FIG. 5 is an exploded perspective view of a chassis portion.

The details of a mounting structure of the platen 11 for the chassis 10 will now be described with reference to FIG. 5. Inclined, upwardly open, holding notches 13 are formed in the upper edges of both side portions of the chassis 10, and flanged bearings 15 mounted on shaft portions 14 positioned on both sides of the platen 11 are fitted in the holding notches 13, with a driving gear 16 connected to one of the shaft portions 14, thus constituting a platen unit 17. The bearings 15 of the platen unit 17 prearranged into a unit are fitted in the holding notches 13. On the side faces of the chassis 10, there are formed positioning lugs 18 and threaded holes 19. Further, there are provided platen fixing plates 23 each having a positioning hole 20 in which the corresponding positioning lug 18 is to be fitted, a mounting hole 21 positioned for alignment with the corresponding threaded hole 19, and an engaging notch 22 for sideway engagement with the corresponding bearing 15. The platen fixing plates 23 are mounted to the chassis 10 with bolts 24, whereby the platen unit 17 is held on the chassis 10.

Figure 6:
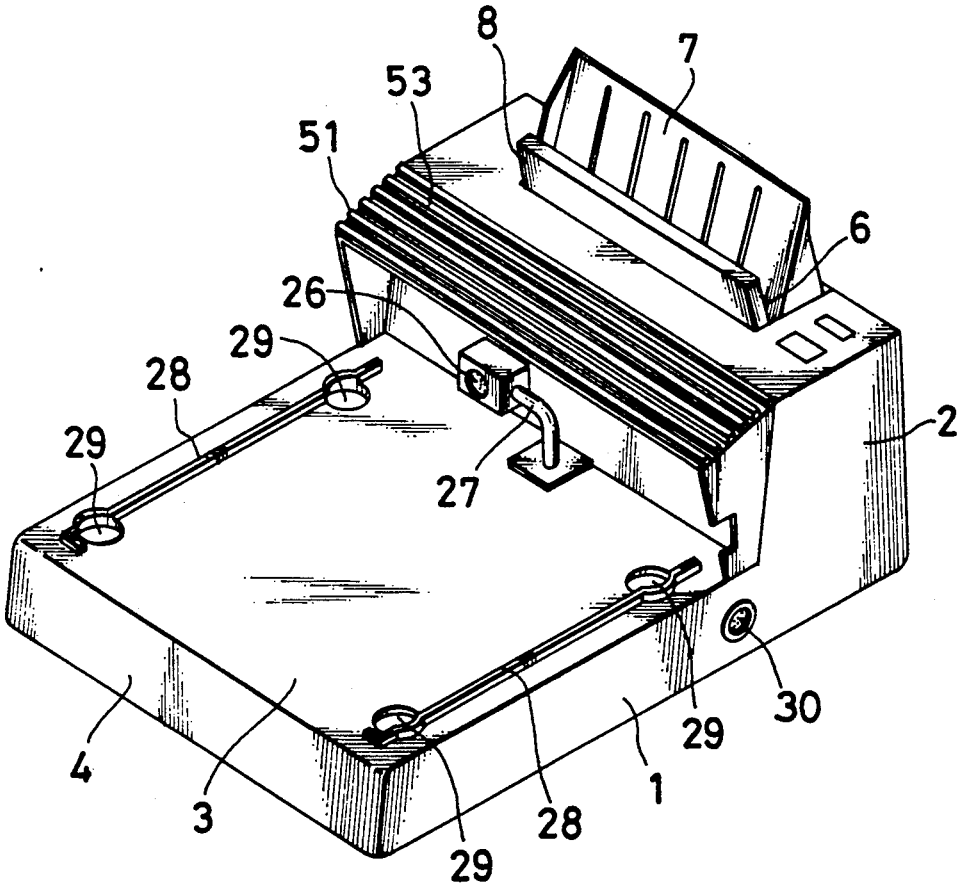
FIG. 6 is a perspective view of a printer as a whole.

In the interior of the terminal loading base 4, there is substantially horizontally mounted a printed circuit board 25 having a control circuit for the thermal head 12, a circuit for controlling the operation of a motor which drives the platen 11, etc. Under the printed circuit board 25, there is mounted a thin, metallic, electroconductive partition plate 36 having an area a little larger than that of the printed circuit board 25. The partition plate 36 functions as both an insulating plate and a guide plate. As shown in FIG. 6, a connection line 27 having a connector 26 at the front end thereof is drawn out from the printed circuit board 25. The connector 26 projects upwards from the printer mechanism housing portion 2 side of the terminal loading base 4. On the terminal loading surface 3, there are formed two terminal positioning ribs 28, and inside the ribs 28, there are formed leg positioning recesses 29. On the side face of the terminal loading base 4, there is provided a jack 30 for the input of an electric power, and a power source 31 (see FIG. 8) provided separately is connected to the jack 30.

Further, a paper passage 32 is formed from the printer mechanism housing portion 2 to the terminal loading base 4. The paper passage 32 is composed of a paper insertion passage 33 and a paper guide passage 32*a*. The paper insertion passage 33 corresponds to a space formed between a bottom plate 58 and the partition plate 36 in the lower portion of the interior of the terminal loading base 4. The paper guide passage 32*a* connects the paper insertion passage 33 and the paper insertion opening 6 with each other in a gently curved form, and it is formed by both a guide 34 positioned just under the platen 11 and a curved guide 35. The curved guide 35 comprises an upper guide 38 as a guide member mounted pivotably about a fulcrum 37 and a lower guide 40 as a guide member mounted pivotably about a fulcrum 39. At the free end of the lower guide 40, there is formed an elastic lug 43 for engagement with and disengagement from a lug 42 formed on a bottom plate 41. Further, a fixing pawl 44 (see FIG. 4) is provided for fixing the upper guide 38 in a predetermined position. An auxiliary guide 45 is provided continuously to the terminal end portion of the lower guide 40. Moreover, a sensor 46 for detecting the presence of the paper 5 is attached to a part of the curved guide 35.

Figure 7:
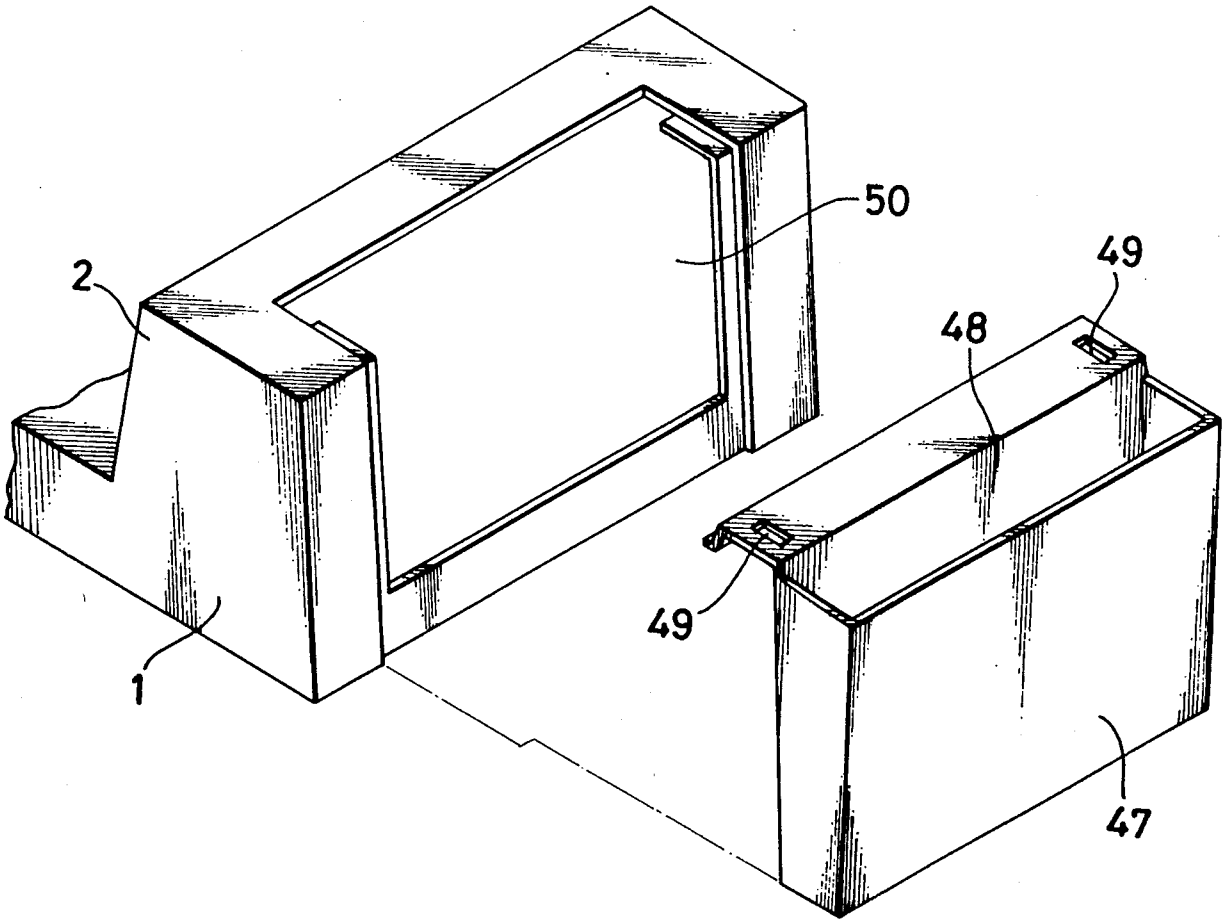
FIG. 7 is a perspective view showing a paper stocker.

A paper stocker 47 is attached to the back of the printer mechanism 2. The structure of the paper stocker 47 will now be described with reference to FIG. 7. The paper stocker 47 is formed as a component which constitutes part of the back and the upper surface of the printer mechanism housing portion 2 and is mounted to the housing portion 2 by retaining means (not shown). The paper stocker 47 has a paper storage portion 48 having an upper opening, and retaining holes 49 for retaining the paper guide 7 are formed in the upper surface of the paper stocker 47. The paper stocker 47 also serves as the back cover of the printer body 1 to cover an opening 50 formed in the printer mechanism housing portion 2.

Figure 8:
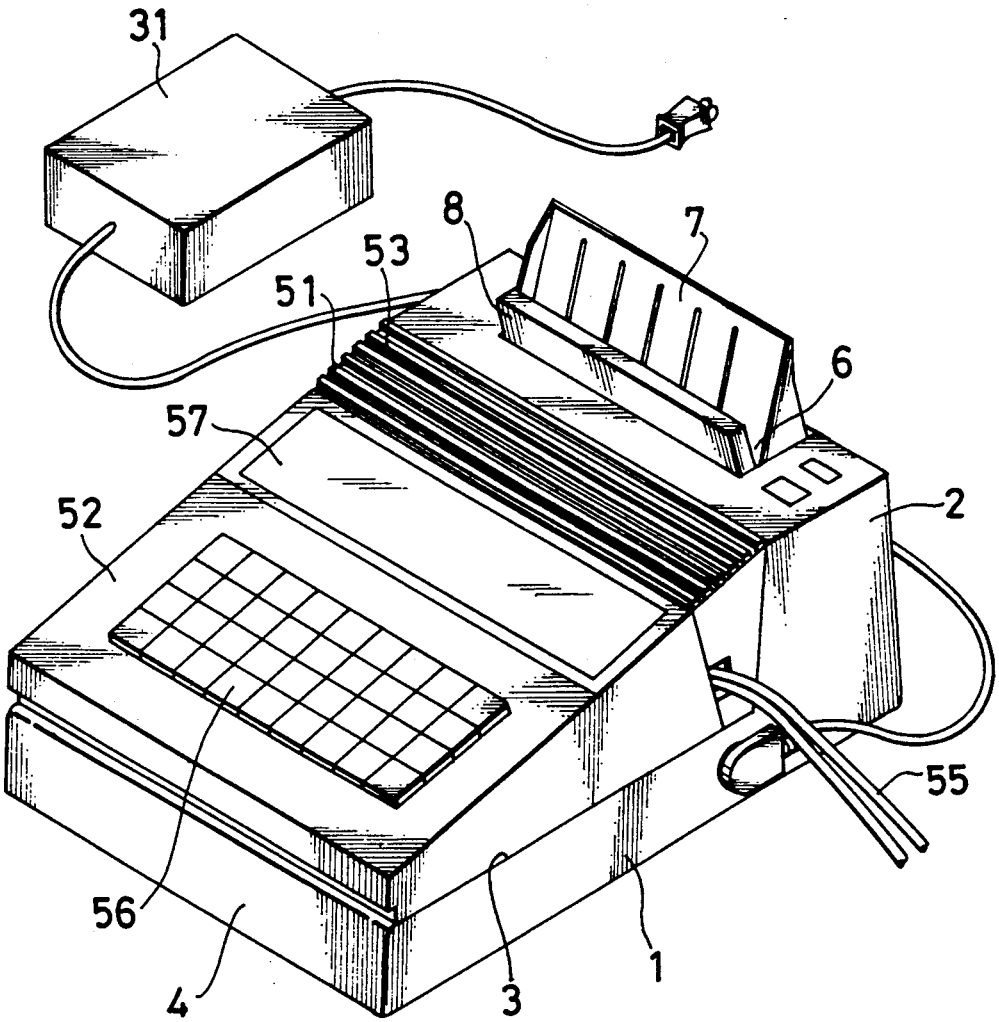
FIG. 8 is a perspective view of a printer as a whole with a terminal mounted.
Figure 9:
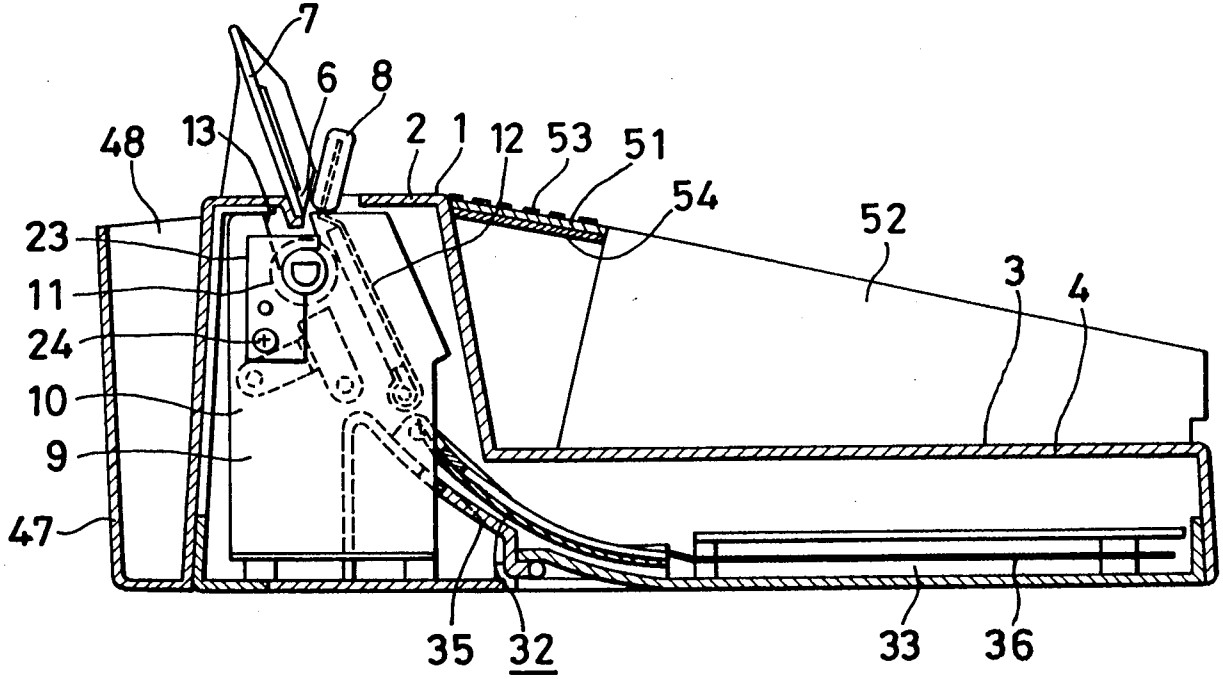
FIG. 9 is a side view in longitudinal section of a printer with a terminal mounted.

A terminal 52 is attached to the terminal, loading surface 3 through a connector cover 51 (FIG. 9). On the upper surface of the connector cover 51, there are formed protrusions 53 for the prevention of slip upon contact of a finger therewith (FIGS. 8 and 9). More particularly, a finger is brought into contact with the protrusions 53 during operation of the head-up lever 8 to thereby improve the operability of the lever. Throughout the inner surface of the connector cover 51, there is formed an electroconductive layer 54 for preventing the trouble of external radio wave. The terminal 52 is connected to the connector 26 and also connected to an external circuit through a telephone line communication cord 55. Further, the terminal 52 is provided with a keyboard 56 and a display unit 57.

In the above construction, sheets of paper 5 are stored in the paper stocker 47, and at the time of printing, one sheet of paper 5 is drawn out from the stocker 47 and is inserted into the printer body 1 through the paper insertion opening 6. Upon issuance of a printing command from an external circuit or the like, the platen 11 rotates to pull the paper 5 inwards. During this operation, the front end of the paper 5 is detected by the sensor 46, and when the paper has been fed by a certain distance after the detection, in other words, when the rear end of the paper 5 has reached the position thereof shown in FIG. 2 which corresponds to the abutment position between the platen 11 and the thermal head 12, the platen 11 stops. Consequently, the greater part of the paper 5 is positioned in the paper passage 32.

When the setting of the paper 5 is over in this way, the platen 10 rotates in the reverse direction so that the paper is moved in the discharge direction. During this movement, a printing signal is applied to the thermal head 12 whereby required matters are printed on the paper.

On the other hand, also in the interior of the terminal loading base 4 for mounting the terminal 52 thereon, the paper passage 32 serves as the paper insertion passage 33. Thus, the space which is usually a dead space is effectively utilized and the space occupied by the printer can be narrowed while ensuring the long paper passage 32, whereby the reduction in size of the printer can be attained. Besides, when the terminal 52 is mounted on the terminal loading base 4, the entirety becomes generally rectangular, and hence the entire system including the terminal 52 is reduced in size.

In the event of a jam of the paper 5 in the paper passage 32, the paper passage 32 is opened by opening the lower guide 40, whereby the jammed paper 5 can be taken out easily. Thus, the lower surface of the paper passage 32 is opened, thereby facilitating the removal of the inside jammed paper 5. Also when dust collects in the paper passage 32, the passage can be easily cleaned.

According to another technique which may be adopted for the removal of dust, etc. deposited on the paper passage 32, the upper cover of the printer body 1 is removed from the bottom plate 41 and the upper guide 38 of the curved guide 35 in the paper passage 32 is opened. In this case, since the upper guide 38 is positioned behind the lower guide 40, even the portion which cannot be opened by the lower guide 40 can be opened. The upper guide 38 is fixed in a predetermined position by engagement with the fixing pawl 44.

On the other hand, the printed circuit board 25 is disposed in the interior of the terminal loading base 4, thereby leading to the reduction in size of the entire system including the terminal 52. The paper 5 passing through the paper passage 32 slides with respect to the components of the paper passage 32, resulting in the generation of static electricity. If this static electricity is generated in the paper insertion passage 33 provided in parallel with the printed circuit board 25, it will exert a bad influence on the circuit components. In this embodiment, the partition plate 36 formed by an electroconductive material, e.g. iron plate, is provided between the printed circuit board 25 and the paper insertion passage 33 and the printed circuit board 25 is grounded using an earth cable (not shown), so there is no fear of an electric charge being accumulated in the vicinity of the printed circuit board 25 and hence an electrically stabilized state is maintained. Further, when the printed circuit board 25 is disposed in the paper insertion passage 33, the paper 5 inserted into the paper insertion passage 33 may be caught on the printed circuit board 25. This is very likely because the paper 5 is guided in a curve by the paper guide passage 32*a*. In this embodiment, it is possible to prevent the paper 5 from being caught on the printed circuit board 25 because the communication between the paper insertion passage 33 and the printed circuit board 25 is cut off by the partition plate 36.

The thermal head 12 can be moved away from the platen 11 by moving the head-up lever 8 in a direction opposed to the paper guide 7. At this time, since the operating force is somewhat strong, the operation is performed by contacting a finger different from the finger on the head-up lever 8 with the protrusions 53 of the connector cover 51. In this way, the force required for the operation can be obtained easily because the protrusions 53 fulfills a slip-stop function.

The connector cover 51 is interposed between the printer mechanism housing portion 2 and the terminal 52. In this connection, the connector 26 and the connection line 27 for connecting the terminal 52 and the internal circuitry with each other are covered with the connector cover 51, thus attaining a waterproofing effect. Besides, since an electroconductive layer 54 is provided on the inner surface of the connector cover 51, there is no fear of external radio wave reaching the connector 26 and the connection line 27, and hence there will be no influence of external noises.

As to the platen 11, the platen unit 17 is formed by mounting the bearings 15 and the driving gear 16 to the platen 11 in advance, then the platen unit 17 is fitted in the holding notches 13 of the chassis 10 and fixed by the platen fixing plates 23. This facilitates the assembly and enables the division of assembling work, thereby enhancing the assembling efficiency. Besides, when the platen 11 is removed from the chassis 10 for maintenance, it is removed as a part of the platen unit 17 and thus the bearings 15, etc. are not disassembled, that is, there is no fear of loss of the components and the operation is easy.

What is claimed is:

1. A printer comprising:

a printer mechanism housing portion which houses therein a printer mechanism including a print head and a platen located at a first position along a paper path, said printer mechanism housing portion having an upper surface and lower side faces, said printer mechanism housing portion comprising a paper insertion opening at said upper surface thereof through which paper is inserted at said upper surface thereof through which paper is inserted into the printer mechanism housing portion;

a flat terminal loading base disposed substantially perpendicular to said printer mechanism housing portion and being continuous to the lower side faces of said printer mechanism housing portion, said flat terminal loading base comprising a paper insertion passage for receiving paper to be printed formed inside of said flat terminal loading base and a terminal loading surface as an upper surface; and means for guiding paper form said paper insertion opening, between and past said print head and said platen in a first direction, and subsequently reversing the direction of paper feed to again feed said paper between said print head and platen in a second opposite direction and subsequently out of said paper insertion opening, said means including a paper guide passage extending from said paper insertion opening in said printer mechanism housing portion to between said print head and the platen to said paper insertion passage in said flat terminal loading base for connecting the paper insertion opening with the paper insertion passage, said paper guide passage includes a portion curved paper guide located at a second position along the paper path which is spaced from the first position of the printer mechanism.

2. A printer according to claim 1, wherein said curved paper guide passage is formed by a lower guide member and an upper guide member which are vertically opposed to each other, said lower guide member comprising a first end which is pivotally connected at a lower end of said printer through pivot means disposed between a bottom plate of said printer mechanism housing portion and a bottom plate of said flat terminal loading base, and a second free end which comprises a first engagement means for engagement with a second engagement means located at the bottom plate of said printer mechanism housing portion, said lower guide member being pivotable between a closed position in which said first and second engagement means are engaged for closing the bottom of said printer mechanism housing portion and an open position in which said first and second engagement means are disengaged and said lower guide member is rotated about said pivot means for opening the bottom of said printer mechanism housing portion.

3. A printer according to claim 1, wherein paper to be printed is fed form the paper insertion opening and is inserted into the paper insertion passage by said printer mechanism, said printer comprising print control circuit means for transporting said paper to be printed from said paper insertion passage path to said printer mechanism for printing and transporting said printed paper to said paper insertion opening.

4. A printer according to claim 1, wherein a printed circuit board having a printing control circuit formed thereon is mounted substantially horizontally along the paper insertion passage in the interior of the terminal loading base.

5. A printer according to claim 4, wherein an insulating plate made of an electroconductive material is disposed between the paper insertion passage and the printed circuit board.

6. A printer according to claim 4, wherein a guide plate for smoothing the flow of paper is disposed between the paper insertion passage and the printed circuit board.

7. A printer according to claim 6, wherein said guide plate is made of an electroconductive material.

* * * * *